US007036681B2

(12) United States Patent
Suda et al.

(10) Patent No.: US 7,036,681 B2
(45) Date of Patent: May 2, 2006

(54) ARTICLE RETRIEVING CONTAINER

(75) Inventors: Kazutake Suda, Tokyo (JP); Chizuko Suda, Tokyo (JP)

(73) Assignee: Kabushiki Kaisha Sudax, Tokyo (JP)

( * ) Notice: Subject to any disclaimer, the term of this patent is extended or adjusted under 35 U.S.C. 154(b) by 251 days.

(21) Appl. No.: 10/471,361

(22) PCT Filed: May 13, 2002

(86) PCT No.: PCT/JP02/04610

§ 371 (c)(1),
(2), (4) Date: Sep. 9, 2003

(87) PCT Pub. No.: WO03/039994

PCT Pub. Date: May 15, 2003

(65) Prior Publication Data

US 2004/0195260 A1 Oct. 7, 2004

(30) Foreign Application Priority Data

Nov. 6, 2001 (JP) ..... 2001-340756

(51) Int. Cl.
*B23Q 7/04* (2006.01)

(52) U.S. Cl. ..... 221/210; 221/249

(58) Field of Classification Search ..... 221/24, 221/229, 249, 247, 248, 210, 220, 255, 232
See application file for complete search history.

(56) References Cited

U.S. PATENT DOCUMENTS

| | | | | |
|---|---|---|---|---|
| 1,186,530 | A | | 6/1916 | Dobrowsky |
| 1,291,231 | A | | 1/1919 | Stokkan |
| 2,705,576 | A | | 4/1955 | Amelio et al. |
| 3,622,041 | A | * | 11/1971 | Borsum ..... 221/202 |
| 3,844,445 | A | | 10/1974 | Haas |
| 4,295,579 | A | | 10/1981 | Haas |
| 4,311,251 | A | | 1/1982 | Sternberg |
| 4,589,575 | A | | 5/1986 | Rugberg et al. |
| 4,958,746 | A | | 9/1990 | Wu |
| 4,966,305 | A | | 10/1990 | Hinterreiter |
| 4,986,442 | A | | 1/1991 | Hinterreiter |
| 4,998,644 | A | * | 3/1991 | Pan ..... 221/24 |
| 5,048,720 | A | | 9/1991 | Hoke |
| 5,071,033 | A | | 12/1991 | Siwek |
| 5,080,258 | A | | 1/1992 | Hinterreiter |

(Continued)

FOREIGN PATENT DOCUMENTS

EP 1512277 5/1978

(Continued)

*Primary Examiner*—Kenneth Noland
(74) *Attorney, Agent, or Firm*—Mitchell P. Brook, Esq.; Luce, Forward, Hamilton & Scripps LLP

(57) ABSTRACT

An article retrieving container in which a novel container for storing articles such as confectionery allowing the articles to be retrieved one by one merely by a cover opening operation is provided, including a container body (3) and a cover body (5) installed on the container body (3), the container body (3) further including an article storage part (21) for storing a plurality of articles (X) such as the confectionery and an article retrieval part (37) having a communication part (41) with the article storage part (21) and an opening for retrieving the articles (X) to the outside, the cover body (5) rotatably installed on the container body (3) further including an article retrieving means (23) for retrieving the articles one by one installed on the inside thereof, whereby the article retrieving means (23) can retrieve the articles (X) by the opening operation of the cover body (5).

4 Claims, 3 Drawing Sheets

U.S. PATENT DOCUMENTS

| | | | | |
|---|---|---|---|---|
| 5,178,298 | A | 1/1993 | Allina | |
| 5,366,112 | A | 11/1994 | Hinterreiter | |
| 5,460,295 | A | 10/1995 | Law | |
| 5,603,429 | A | 2/1997 | Mulhauser et al. | |
| 5,785,206 | A | 7/1998 | Chan et al. | |
| 5,791,514 | A | 8/1998 | Kirk, III et al. | |
| 6,119,894 | A * | 9/2000 | Hassan | 221/288 |
| D459,218 | S | 6/2002 | Senda et al. | |
| 6,425,495 | B1 * | 7/2002 | Senda et al. | 221/24 |

FOREIGN PATENT DOCUMENTS

| | | |
|---|---|---|
| EP | 0629562 | 12/1994 |
| JP | 42-18445 | 10/1942 |
| JP | 44-19037 | 8/1969 |
| JP | 48-764 | 1/1973 |
| JP | 52-165852 | 12/1977 |
| JP | 60-101468 | 7/1985 |
| JP | 63-63463 | 3/1988 |
| JP | 3-75107 | 3/1991 |
| JP | 04-189784 | 7/1992 |
| JP | 11-079262 | 3/1999 |
| JP | 11-208746 | 8/1999 |
| JP | 11-255210 | 9/1999 |
| JP | 2000-025854 | 1/2000 |
| JP | 2000-159279 | 6/2000 |
| JP | 2001-019064 | 1/2001 |
| WO | WO 96/33927 | 10/1966 |

* cited by examiner (a)

(b)

ARTICLE RETRIEVING CONTAINER

TECHNICAL FIELD OF THE INVENTION

The present invention relates to an article retrieving container for retrieving small articles one by one, and in particular to a container that stores articles, such as confectionery or health foods, solidified in a tablet-like shape and retrieves them one by one.

RELATED ARTS

JP 04-189784 A discloses a known conventional container for confectionery and food. This container is used to retrieve confectionery or the like stored in the container using a pinch member that is formed in a shape of an animal, a robot, a human, or an animation character and is attached to the outside of the container.

As can be seen from the shape and the description in the above patent document, it is assumed that the container is used on a table or the like and the pinch member is fixed to the outside of the container as a protrusion.

Also, it is not assumed that the container is carried in a packet, so that a cover member for covering a storage part of the container so as to prevent the popping-out of the articles is not provided.

DISCLOSURE OF THE INVENTION

The present invention has been made in view of the problems described above, and provides a novel container for storing articles having a tablet-like shape, such as confectionery or nourishing foods, and retrieving them at will, where the container has a shape suited for carrying, is capable of preventing an accidental popping-out of the articles by covering an outlet opening at the time of disuse like carrying, and is capable of retrieving the articles one by one merely by a cover opening operation. Also, the present invention provides a structure with which a chipping and the like of the articles are prevented and the articles are retrieved smoothly.

In order to solve the above-mentioned problems, according to a first aspect of the present invention, the following structure is adopted. That is, the present invention relates to an article retrieving container including:

a container body;

a cover body installed on the container body; and an article retrieving means that operates in an interlocked manner with the cover body, in which the container body includes an article storage part for storing a plurality of articles and an article retrieval part having an opening through which the articles are to be retrieved to the outside, between the article storage part and the article retrieval part, a communication part is provided through which the articles move from the article storage part to the article retrieval part, the cover body is rotatably installed on the container body and openably closes the opening, and the article retrieving means retrieves an article positioned in the article retrieval part by an opening operation of the cover body.

Further, according to a second aspect of the present invention, in the first aspect of the present invention, the article retrieving container is characterized in that the article retrieving means has a pinch part for pinching the articles, that an article is pinched by the pinch part when the cover body is closed, and the pinched article is retrieved to the outside when the cover body is opened.

Further, according to a third aspect of the present invention, in the first or second aspect of the present invention, the article retrieving container is characterized in that the article retrieving part is provided with an article holding part for holding the article at a predetermined position while maintaining an attitude of the article and a regulating member having a regulating part for preventing entry of a new article from the communication part when the cover body is opened.

According to a fourth aspect of the present invention, in the third aspect of the present invention, the article retrieving container is characterized in that the cover body and the regulating member coaxially rotate while contacting each other, and a rotation force generated by the opening and closing operations of the cover body is transmitted to the regulating member through a contact portion therebetween and rotates the regulating member.

According to a fifth aspect of the present invention, in any one of the first to fourth aspects of the present invention, the article retrieving container is characterized in that in order to prevent an article that is passing through the communication part from being obstructed by other articles from a direction that is different from a passing direction, a limiting member for limiting movement of the other articles is provided in the article storage part in the vicinity of the communication part.

PREFERRED EMBODIMENTS

Figure 1:
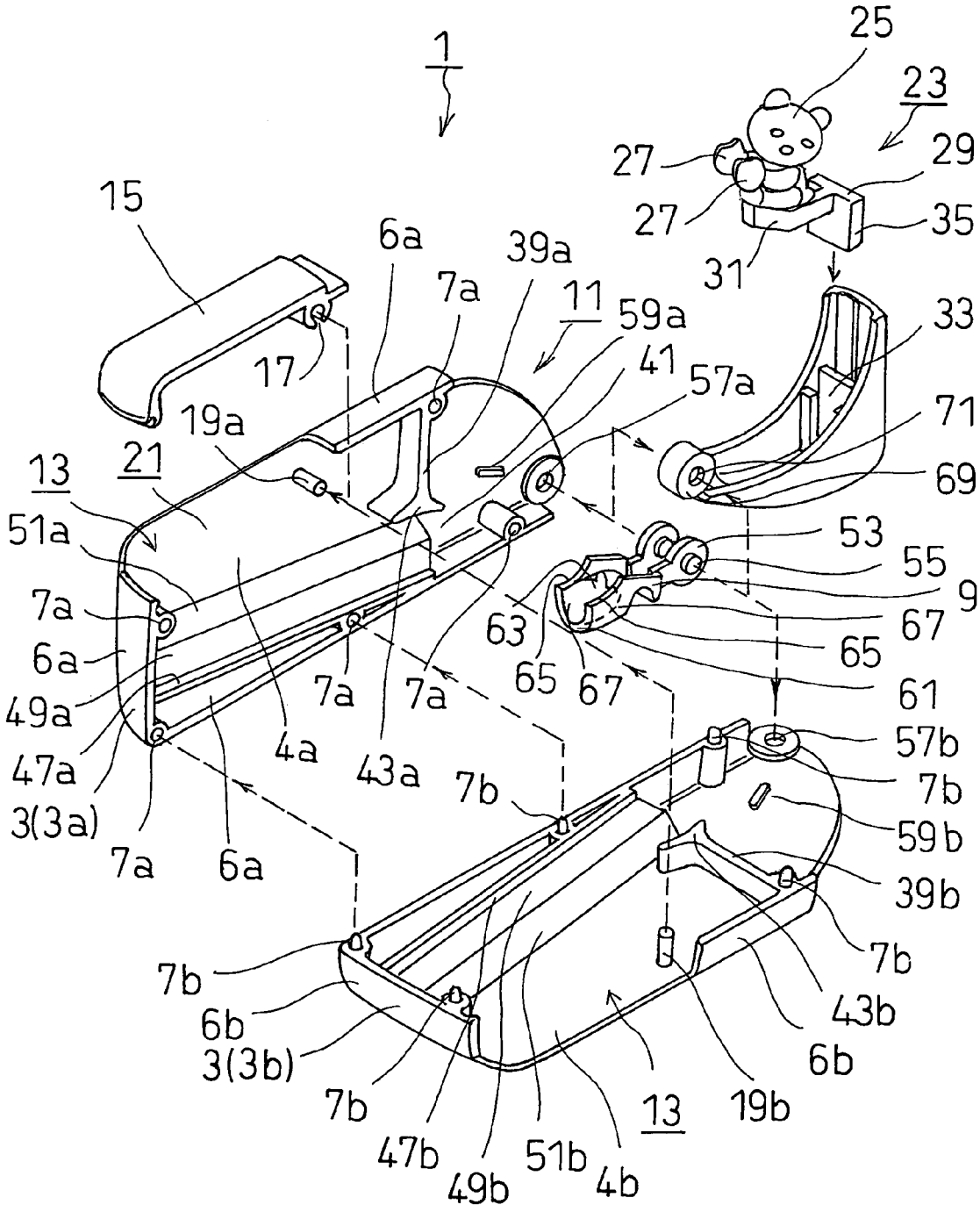
FIG. 1 is an exploded perspective view of an article retrieving container according to the present invention.
Figure 2:
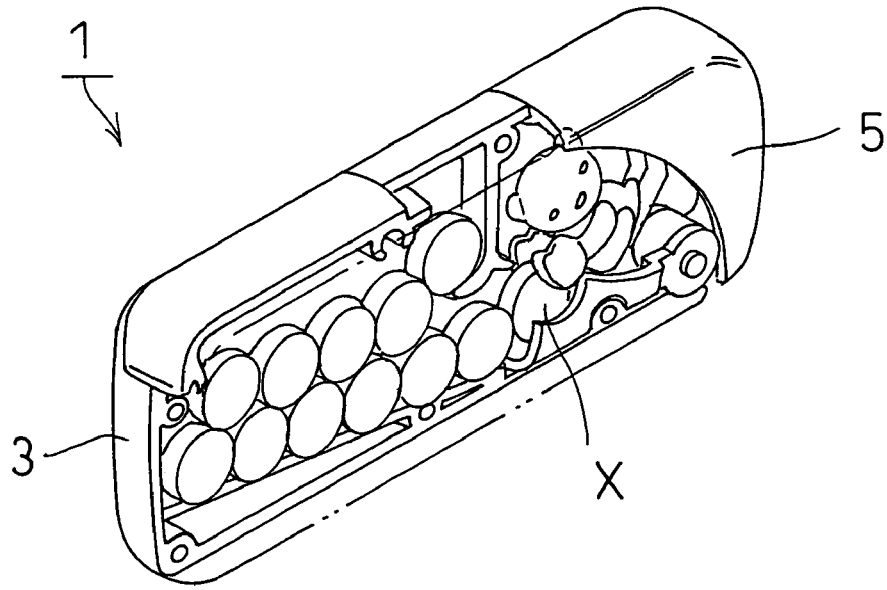
FIGS. 2A and 2B are each a transparent view showing an internal mechanism of the article retrieving container according to the present invention.
Figure 2:
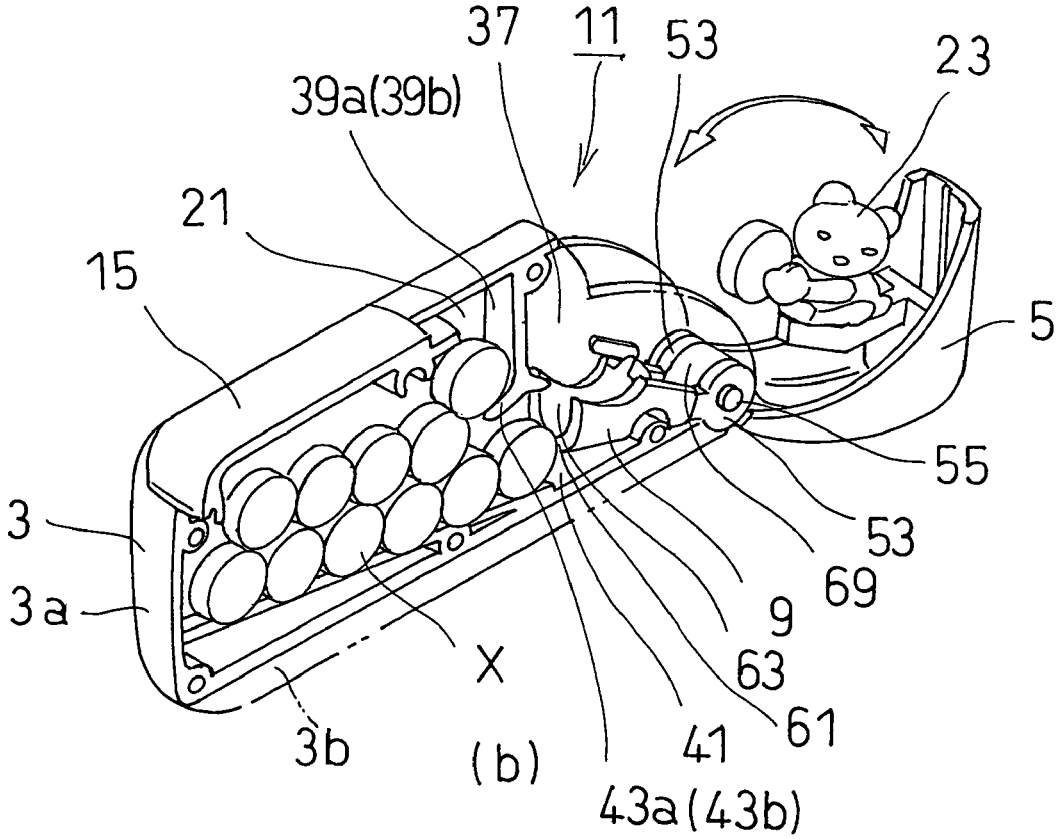
Figure 3:
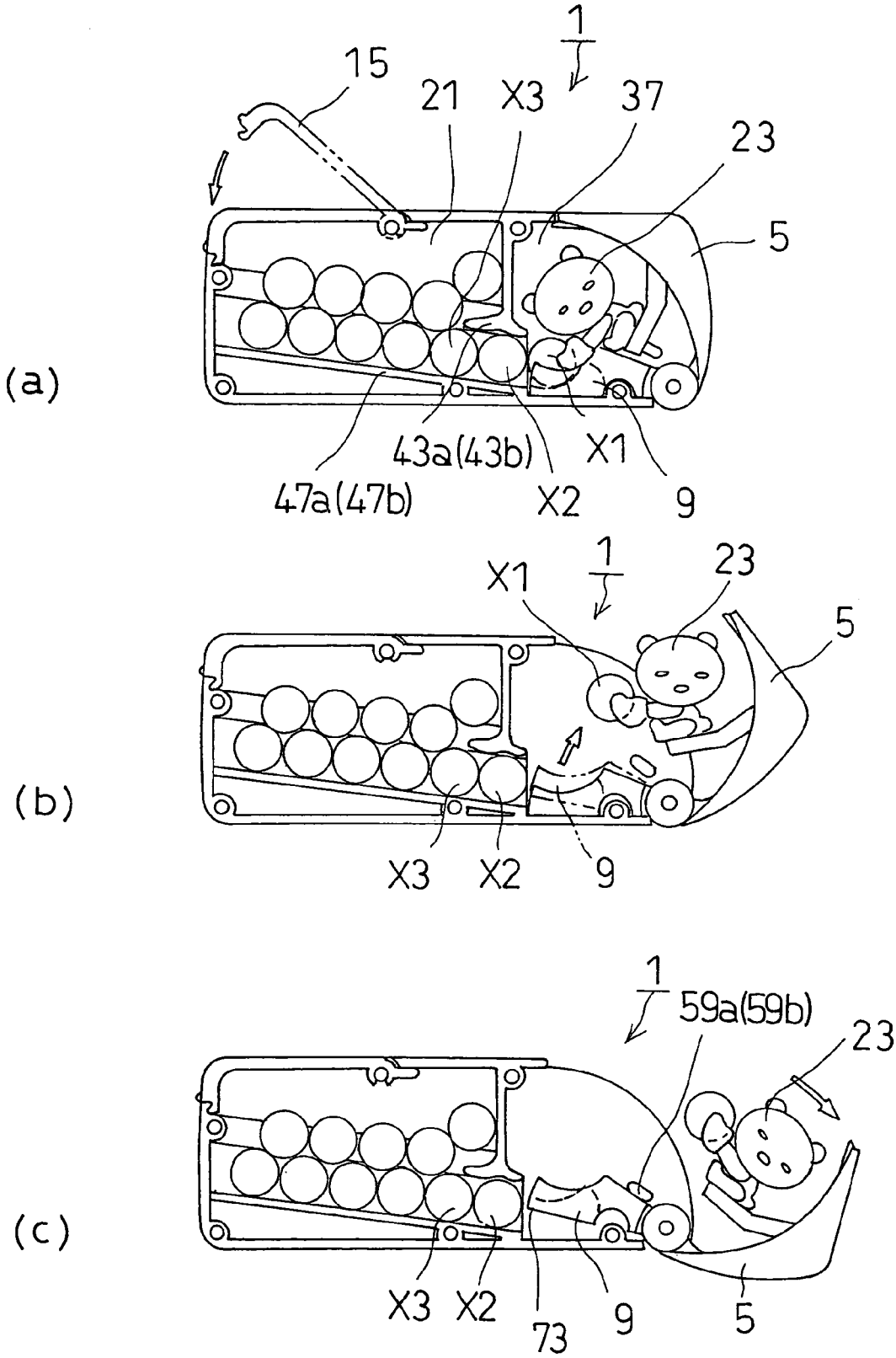
FIGS. 3A, 3B, and 3C are each an explanatory drawing illustrating a mechanism of the article retrieving container according to the present invention.

An embodiment of the present invention will now be described with reference to the accompanying drawings. FIG. 1 is an exploded perspective view of an article retrieving container according to the present invention, FIGS. 2A and 2B are each a transparent view showing an internal mechanism of the article retrieving container, and FIGS. 3A to 3C are each an explanatory drawing illustrating a mechanism of the article retrieving container.

First, a main structure of a container 1 will be described.

In FIG. 1, reference numeral 1 denotes the article retrieving container (hereinafter simply referred to as the "container") according to the present invention. This container 1 includes a container body 3 and a cover body 5 installed on the container body 3, each of the container body 3 and the cover body 5 being produced through molding of a synthetic resin.

Also, the container body 3 is obtained by setting a left container body 3*a* and a right container body 3*b* so as to oppose each other and joining them to each other. The container bodies 3*a* and 3*b* respectively include side walls 4*a* and 4*b* formed in an approximately rectangular shape except for an article retrieving side to be described later, and peripheral walls 6*a* and 6*b* formed on the outer edges of the side walls 4*a* and 4*b* except for portions such as an opening to be described later. Also, the end surfaces of the peripheral walls 6*a* and 6*b* are portions that are abutted each other. Here, multiple fitting holes 7*a* and multiple fitting projections 7*b* are respectively formed on the end surfaces of the peripheral walls 6*a* and 6*b*, and the container bodies 3*a* and 3*b* are coupled through the fitting of the fitting projections 7*b* into the fitting holes 7*a*.

It should be noted here that the left container body 3*a* and the right container body 3*b* are produced to be symmetrical to each other. Therefore, in the following description, unless otherwise specified, each element given a reference symbol including "a" will describe an element provided for the left container body 3*a* and each element assigned a reference symbol including "b" will describe an element provided for the right container body 3*b*.

Also, in the following description, unless otherwise described, the terms "top", "bottom", "right", and "left" respectively correspond to the top, bottom, right, and left in the drawings.

The cover body 5 is rotatably attached to the container body 3 having the structure described above through a regulating member 9 to be described later, and openably closes an opening 11 formed on one side of the container body 3. An article supplying opening 13, through which articles X are to be supplied, is further formed on the container body 3 and is openably closed by an article supplying cover 15. The article supplying cover 15 has a bearing part 17 having an approximately C-shaped cross section and is rotatably pivoted by a shaft obtained through abutment of posts 19*a* and 19*b* that are respectively formed on the left container body 3*a* and the right container body 3*b*. Also, the posts 19*a* and 19*b* are abutted each other and achieve a function of maintaining an optimum distance between the left container body 3*a* and the right container body 3*b* and maintaining a volume of a space formed between the container bodies 3*a* and 3*b* (article storage part 21 to be described later) in defiance of a pressing force and the like from the outside.

The cover body 5 is provided with an article retrieving means 23 for pinching and retrieving the articles X, and this article retrieving means 23 is provided with an ornament member 25 produced in the shape of an animal or the like through molding of a synthetic resin. This ornament member 25 is provided with a pair of pinch means 27, 27 that are arranged so that a gap that is somewhat smaller than the thickness of the articles X is maintained therebetween. The articles X are pinched and grasped by the pair of pinch means 27, 27 with a moderate force due to an elasticity of the pinch means.

Also, the ornament member 25 is attached to the cover body 5 through an attachment member 29 that includes an arm 31 for placing and fixing the ornament member 25 and a flange 35 fitted into a fitting part 33 provided on the cover body 5. The cover body 5, the attachment member 29, and the ornament member 25 are strongly fixed by an adhesive or a predetermined fixing means at the time of completion of the container 1. Here, it is conceivable that the ornament member 25 is replaced with a member having a different format the time of production. Therefore, these members are produced as separated members, thereby making it easy to cope with the changing of specifications.

Next, structures of the container body 3, the regulating member 9 provided inside the container body 3, and the cover body 5 will be described in more detail.

First, the container body 3 will be described. As described above, the container body 3 is a member obtained by setting the left container body 3*a* and the right container body 3*b* so as to oppose each other and coupling them to each other, and has an approximately rectangular parallelepiped shape whose outside dimensions are around 10 mm in width, around 30 mm in height, and around 70 mm in length under a state where the cover body 5 is attached. That is, the container bodies 3*a* and 3*b* are each formed in a size and shape with which putting into the pocket of clothes for carrying is not hindered. Also, in the container body 3, an article storage part 21 for storing the multiple articles X and an article retrieval part 37 are provided adjacent to each other. The article storage part 21 and the article retrieval part 37 are each a space surrounded by the side walls 4*a* and 4*b* and the peripheral walls 6*a* and 6*b* of the left container body 3*a* and the right container body 3*b* described above.

The article storage part 21 and the article retrieval part 37 are partitioned from each other by partition members 39*a* and 39*b* that are respective members integrally formed perpendicular to the inside walls of the container bodies 3*a* and 3*b*. These partition members 39*a* and 39*b* are abutted each other in their end portions and partition the inside space of the container 1.

As described above, the partition members 39*a* and 39*b* are each a member for partitioning between the article storage part 21 and the article retrieval part 37, and these members are formed to leave an opening having a size with which the articles X are capable of passing through. That is, a space (height) that is somewhat larger than an external shape of the articles X (diameter of the articles, in this embodiment) is left and a communication part 41 is formed as an opening for establishing communication between the article storage part 21 and the article retrieval part 37.

In the end portions of the partition members 39*a* and 39*b*, limiting members 43*a* and 43*b* are further formed which are each a projection piece shaped partition that protrudes toward the article storage part 21 and the article retrieval part 37 and approximately parallel to a passage 45 (to be described later) through which the articles X moves. In this embodiment, the length of each of the limiting members 43*a* and 43*b* is set approximately equal to the external shape (diameter size) of the articles X.

The article storage part 21 is provided with the passage 45 described above. This passage 45 is a portion for arranging the articles X in a row and supplying the articles X to the article retrieval part 37 in order starting from the article positioned in an end portion of the passage 45.

The passage 45 is an upwardly opened groove-shaped portion whose side walls and bottom wall are formed by members protruding from the container bodies 3*a* and 3*b* to the inside of the article storage part 21. Also, the passage 45 is descended in a direction from an end portion of the container 1 to the communication part 41 along the longitudinal direction of the container 1. Further, the height of each of the side walls is set approximately equal to the external shape (diameter size) of the articles X, and the width of the bottom wall is set somewhat larger than a thickness size of the articles X.

In more detail, the passage 45 is a portion formed by bottom walls 47*a* and 47*b* serving as the bottom part and side walls 49*a* and 49*b* positioned on both sides of the bottom walls 47*a* and 47*b*. In addition, slope parts 51*a* and 51*b* ascending toward the outside in a direction which widens the opening are respectively provided at the top ends of the side walls 49*a* and 49*b*.

The passage 45 having the shape described above holds the circular articles having a width smaller than the outside dimensions under a state where the articles stand upright, and guides the articles so as to roll inside the passage 45 along the descending slope.

Next, the regulating member 9 will be described. The regulating member 9 is a member that regulates the entry of the articles X from the article storage part 21 into the article retrieval part 37 through the communication part 41, and sets the articles X in a predetermined attitude so that the articles X are grasped appropriately by the aforementioned pair of pinch means 27, 27 of the article retrieving means 23.

The regulating member 9 is formed through integral molding of a synthetic resin. In one end portion thereof, one pair of bearing pieces 53, 53 are formed which are bifurcated so as to extend parallel to each other. At the front and back (outside and inside) of each of the bearing pieces 53, 53, protrusions 55 are coaxially formed so as to serve as a rotation shaft. That is, the protrusions 55, 55 provided outside the bearing pieces 53, 53 are respectively pivoted by bearing holes 57*a* and 57*b* provided in predetermined portions of the container bodies 3*a* and 3*b*, thereby allowing the regulating member 9 to be rotated within a range regulated by protrusions 59*a* and 59*b* provided on the container bodies 3*a* and 3*b* and the peripheral walls 6*a* and 6*b*.

On the other end side of the regulating member 9, an article holding part 63 is provided which has an opening end 61 that opposes the communication part 41. This article holding part 63 is a portion for holding one of the articles X while maintaining the attitude in row of the article X in the passage 45, and is formed by supporting walls 67, 67 that are each partially cut out to obtain cutout portions 65, 65. The cutout portions 65, 65 are each a clearance part provided to prevent the interferences among the members. With this structure, the pair of pinch means 27, 27 of the article retrieving means 23 becomes capable of grasping the articles X in the vicinity of the center of the articles X.

Next, the cover body 5 will be described. As shown in the drawing, the cover body 5 is a member having an approximately triangular shape and forms a corner part of the container 1 on one side in the longitudinal direction. Also, a bearing part 69 is provided on an end portion of the cover body 5.

The bearing part 69 is provided with a hole 71 and this hole 71 is fitted to the protrusions 55, 55 respectively provided inside the pair of the bearing pieces 53, 53 of the regulating member 9. With this structure, the cover body 5 is rotated about the protrusions 55, 55. Further, the cover body 5 is coaxially supported by the rotation shaft of the regulating member 9 while slidably contacting the regulating member 9 pivoted by the left container body 3*a* and the right container body 3*b*. That is, the bearing part 69 of the cover body 5 is pinched by the pair of the bearing pieces 53, 53 of the regulating member 9 and the regulating member 9 is rotated within the certain range by following the rotation of the cover body 5 due to a frictional force therebetween.

Next, an operation, a usage method, and the like of the container 1 will be described with reference to FIGS. 2A and 2B and FIGS. 3A to 3C.

FIG. 2A is a partial transparent view showing a state where the multiple articles X are stored in the container 1 and the cover body 5 is closed, while FIG. 2B is a partial transparent view showing a state where the cover body 5 is opened and one of the articles X is retrieved.

In this embodiment, as an optimum example, the container 1 is formed so as to be suited for storing tablet-like circular articles having a predetermined thickness. As to the external shape of the container 1, the corner portions are each set as a curved surface beveled with a predetermined radius, although the overall shape of the container 1 is set as a thin and rectangular parallelepiped shape. As shown in FIGS. 2A and 2B, in the container 1, the articles X are stored so as to be stacked together in the diameter direction but not to be stacked together in the thickness direction.

Further, as described above, in the article storage part 21, there are provided the passage 45 and the slope parts 51*a* and 51*b* that are inclined so as to lead the articles X into the passage 45. As a result, when the container 1 is set upright as shown in FIGS. 2A and 2B, the articles X are led into the passage 45 along the slope parts 51*a* and 51*b*. The passage 45 is descended toward the communication part 41, so that a moving force toward the communication part 41 is exerted on the articles X due to their self-weights and the articles X move along the slope.

FIG. 2A shows a state where the cover body 5 is closed. Under this state, the aforementioned rotatable regulating member 9 is set at a lowered position, so that one of the articles X is supplied to the article holding part 63 through the passage 45, the communication part 41, and the opening end 61, and the attitude of the article X is maintained by the article holding part 63. At the same time, the pinch means 27 of the article retrieving means 23 pinch the article X held by the article holding part 63 in the width direction.

FIG. 2B shows a state where the cover body 5 is opened. Under this state, the aforementioned rotatable regulating member 9 is set at a raised position, so that the opening end 61 blocks the communication part 41 and prevents the entry of other articles X into the article holding part 63. At the same time, the article X grasped by the pinch means 27 of the article retrieving means 23 is retrieved from the article retrieval part 37.

As described above, when the cover body 5 is closed, one of the articles X is grasped by the article retrieving means 23. Following this, when the cover body 5 is opened, the grasped article X is retrieved by the article retrieving means 23.

The above-mentioned retrieval of the articles X by the opening and closing operations of the cover body 5 will be described in more detail with reference to FIGS. 3A, 3B, and 3C. FIGS. 3A, 3B, and 3C are each a transparent view of the container 1 from a side.

FIG. 3A is a transparent view from the side showing the same state as in FIG. 2A described above. That is, FIG. 3A shows a state where the cover body 5 is closed and an article X1 supplied to the article holding part 63 is pinched by the pinch means 27 of the article retrieving means 23. Also, an article X2 that is to be next supplied to the article holding part 63 stays in the end portion of the passage 45. Under this state, the article X2 is pushed by the next article X3 toward the article holding part 63 but is not capable of moving further toward the article holding part 63 because the article X1 already exists in the article holding part 63. As a result, the article X2 stays at the position described above.

Above the end portion of the passage 45 in which the article X2 stays, there is provided the limiting member 43*a* (43*b*) formed integrally with the partition members 39*a* and 39*b*. This limiting member 43*a* (43*b*) is a partition member that is provided above the passage 45 immediately before the communication part 41 so as to extend along the communication part 45 while maintaining a height through which the articles X are capable of passing.

The limiting member 43*a* (43*b*) is a member provided to prevent the article X2 from being pushed by the articles other than the next article X3 while the article X2 is moving toward the article holding part 63. With this structure, the smooth supply of the articles is realized. Also, at the time of retrieval of the article X1, although the article X2 receives a force from the article X1 and attempts to move upwardly, the limiting member 43*a* (43*b*) exists above the article X2, so that the upward movement of the article X2 is prevented and the article X1 and the article X2 are smoothly separated from each other.

FIG. 3B shows a state where an opening operation of the cover body 5 is started and the opening end 61 (article holding part 63) side of the regulating member 9 is raised as the cover body 5 is opened.

When the opening operation of the cover body 5 is started, the regulating member 9 receives a force for rotating in the same direction as the cover body 5 because this regulating member 9 slidably contacts the bearing part 69. As a result, the opening end 61 of the regulating member 9 is raised and blocks the communication part 41 as a regulating part. In this manner, the entry of the next waiting article X2 is prevented.

FIG. 3C shows a state where the cover body 5 is completely opened and the article X1 is retrieved to the outside of the article retrieval part 37. Also, the regulating member 9 is rotated to a position at which this regulating member 9 is abutted against the protrusion 59*a* (59*b*).

Under this state, an edge portion 73 of the opening end 61 is abutted against a portion of the next waiting article X2 that is protruded most toward the opening end 61 side. Next, when a closing operation of the cover body 5 is started, the regulating member 9 is lowered and the next article X2 is held by the article holding part 63. When the cover body 5 is completely closed, the article X2 is pinched by the pinch means 27 of the article retrieving means 23. By repeating these opening and closing operations of the cover body, the articles can be retrieved one by one.

As described above, the edge part 73 is abutted against the most protruding portion of the article X2. This is because it is required to reduce the movement (backward movement) of the article X2 toward the opening end 61 side to a minimum. If the next article X2 and its following articles arranged in a row in the passage 45 move backward in the passage at the time of retrieval of the articles X, there arises the following problem. That is, the articles existing in the passage 45 receive a force due to their self-weights and the like while contacting each other, and move toward the communication part 41 side along the slope of the passage 45. If the articles are allowed to move backward under this state, the articles stacked together receive a force acting in a direction opposite to the direction described above. As a result, there is a fear in that these articles may be damaged in some cases. In view of this problem, it is preferable to adopt a structure in which the backward movement of the articles in the passage 45 is suppressed as much as possible.

Explanation of the Referential Numerals

1 Container. 3 Container body. 5 Cover body. 3*a* Left container body. 3*b* Right container body. 4*a* Side wall. 4*b* Side wall. 6*a* Peripheral wall. 6*b* Peripheral wall. 7*a* Fitting hole. 9 Regulating member. 11 Opening. 13 Article supplying opening. 15 Article supplying cover. 17 Bearing part. 19*a* Post. 19*b* Post. 21 Article storage part. 23 Article retrieving means. 25 Ornament member. 27 Pinch means. 29 Attachment member. 31 Arm. 33 Fitting part. 35 Flange. 37 Article retrieval part. 39*a* Partition member. 39*b* Partition member. 41 Communication part. 43*a* Limiting member. 43*b* Limiting member. 45 Passage. 47*a* Bottom wall. 47*b* Bottom wall. 49*a* Side wall. 49*b* Side wall. 51*a* Slope part. 51*b* Slope part. 53 Bearing pieces. 55 Protrusion. 57*a* Bearing hole. 57*b* Bearing hole. 59*a* Protrusion 59*b* Protrusion. 61 Opening end. 63 Article holding part. 65 Cutout portion. 67 Supporting wall. 69 Bearing part. 71 Hole. 73 Edge part. X Article.

INDUSTRIAL APPLICABILITY

As described above, the present invention provides a technique applicable to an article retrieving container and provides effects described below.

According to a first aspect of the present invention, the cover body is provided with consideration given to the carrying in a pocket and the sanitary aspect, and a figure formed in the shape of an animal or an animation character retrieves articles, such as confectionery, one by one as the cover body is opened. As a result, as distinct from the conventional container that is not suited for carrying because no cover is provided and a character figure or the like is provided outside thereof, the article retrieving container according to the present invention is superior in portability, is hygienic, and is capable of retrieving confectionery or the like while exhibiting a character figure or the like to a user when the cover body is opened.

Also, the external shape of the container is set as a thin and rectangular parallelepiped shape as described in the embodiment, so that an article retrieving container that is more suited for carrying can be provided.

Also, according to a second aspect of the present invention, the grasping of the articles is performed by the article retrieving means that pinch the articles in the thickness direction by utilizing its elasticity. The article retrieving means has the structure described above, making it possible to set the width of the article retrieving means within a size that is somewhat larger than the thickness of the articles. The article retrieving container according to the present invention adopts such an article retrieving means, resulting in a reduction of the width of the cover body which is a member to be mounted. Also, the article retrieving means is set as an ornament having a shape such as an animal or an animation character, so that the articles are grasped and retrieved to the outside by the ornament when the cover is opened. Consequently, it becomes possible to provide an article retrieving container that is thin and suited for carrying and to entertain a user by exhibiting the ornament each time an article is retrieved using the article retrieving means.

Also, according to a third aspect of the present invention, the regulating member is provided which has a function of maintaining the attitude of the articles and preventing the entry of the next article. Consequently, the articles can be retrieved one by one with reliability.

Further, the two functions of maintaining the attitude of the articles and preventing the entry of the next article are simultaneously achieved by the regulating member. Consequently, the size of the container is reduced and it becomes possible to miniaturize the external shape of the article retrieving container including the regulating member.

Also, according to a fourth aspect of the present invention, the regulating member and the cover body are coaxially rotated and slidably contact each other. Consequently, it becomes possible to allow the regulating member to be rotated by following the rotation of the cover body using such an extremely simple mechanism.

Also, this structure is suitably fitted in the thickness direction of the thin container described in the embodiment, so that it becomes possible to reduce the thickness of the container and to provide an article retrieving container that is suited for carrying.

Also, according to a fifth aspect of the present invention, the limiting member is provided in the vicinity of the communication part in the article storage part, so that the movement of articles obstructing the movement of an article supplied to the article retrieval part is limited. Consequently, it becomes possible to provide an article retrieving container that is capable of smoothly supplying articles and retrieving them with reliability.

What is claimed is:

1. An article retrieving container comprising:

a container body;

a cover body installed on the container body; and an article retrieving element that operates in an interlocked manner with the cover body; wherein:

the container body includes an article storage part for storing a plurality of articles and an article retrieval part having an opening through which the articles are to be retrieved to the outside;

the cover body is rotatably installed on the container body and openably closes the opening;

the article retrieving element retrieves an article positioned in the article retrieval part by an opening operation of the cover body;

the article retrieval part is provided with an article holding part that retains the article in a predetermined position while maintaining an attitude of the article;

the article retrieval part is provided with a regulating member having a regulating part preventing entry of a new article from a communication part when the cover body is opened; and, the cover body and the regulating member coaxially rotate while contacting each other, and a rotation force generated by the opening and closing operations of the cover body is transmitted to the regulating member through a contact portion therebetween and rotates the regulating member.

2. An article retrieving container according to claim 1, wherein the article retrieving element has a pinch part for pinching the articles, wherein an article is pinched by the pinch part when the cover body is closed, and the pinched article is retrieved to the outside when the cover body is opened.

3. An article retrieving container according to claim 2, wherein in order to prevent an article that is passing through the communication part from being obstructed by other articles from a direction that is different from a passing direction, a limiting member for limiting movement of the other articles is provided in the article storage part in the vicinity of the communication part.

4. An article retrieving container according to claim 1, further comprising:

a communication part between the article storage part and the article retrieval part through which the articles move from the article storage part to the article retrieval part.

* * * * *